United States Patent [19]

Ellingson et al.

[11] Patent Number: 4,470,050

[45] Date of Patent: Sep. 4, 1984

[54] ANTENNA ROTATOR WITH FRICTION DRIVE

[75] Inventors: Gary L. Ellingson, Thief River Falls, Minn.; Wendell E. Miller, Warsaw, Ind.

[73] Assignee: Polar Research, Inc., Thief River Falls, Minn.

[21] Appl. No.: 477,982

[22] Filed: Mar. 23, 1983

Related U.S. Application Data

[62] Division of Ser. No. 272,313, Jun. 10, 1981.

[51] Int. Cl.[3] ..... H01Q 3/02

[52] U.S. Cl. ..... 343/766; 343/882

[58] Field of Search ..... 343/757, 758, 763, 766, 343/878, 879, 880, 882; 211/163; 362/35, 145, 190, 191, 250, 431; 52/110

[56] References Cited

U.S. PATENT DOCUMENTS

| | | | |
|---|---|---|---|
| 1,729,004 | 9/1929 | Miadowicz | 211/163 |
| 1,790,338 | 1/1931 | Chartoff | 211/163 |
| 2,623,999 | 12/1952 | Kulikowski | 343/758 |
| 3,146,452 | 8/1964 | Rose | 343/758 |

*Primary Examiner*—Eli Lieberman

*Attorney, Agent, or Firm*—Wendell E. Miller

[57] ABSTRACT

The present invention provides an apparatus and a method for mounting and both separate and selective rotational positioning of a plurality of antennas, or search devices, that are attached to the face of a tower. The preferred embodiment includes an antenna-mounting ring, or search-device mounting ring (142) that is attached to the tower (12) by a plurality of support rollers (160, 186, or 219). The antenna-mounting ring is rotationally positioned by a drive motor (214), and by a friction drive element that is connected to the drive motor and that engages the antenna-mounting ring. Preferably, one of the support rollers serves as the friction drive element.

20 Claims, 7 Drawing Figures

ANTENNA ROTATOR WITH FRICTION DRIVE

This is a division of application Ser. No. 06/273,313, filed June 10, 1981.

The present invention relates generally to antenna tower assemblies, and more particularly to apparatus and methods for mounting and rotating a plurality of vertically-spaced antennas on a single antenna tower.

BACKGROUND ART

It is common practice to mount a plurality of separate antennas, which may include both receiving and transmitting antennas, on a single atenna tower. Further, it is traditional practice to mount one of the antennas on the top of the antenna tower and to rotate the one antenna by means of an electric motor and gear reducer. The remainder of the antennas are then mounted to the face of the antenna tower at various heights thereto. Thus only one antenna, that is, the antenna which is mounted to the top of the tower, is rotatable, and the remainder of the antennas are fixedly secured to the antenna tower.

Alternately, several antennas are mounted to one antenna rotator on the top of the antenna tower. This method of mounting has the disadvantage that all antennas must be rotated together, thus greatly diminishing the usefulness of the various antennas. Also, this method of mounting is limited in the type and number of antennas that can be rotated because of structural limitations.

When it has been desirable, or necessary, to rotate one of the face-mounted antennas, it has been customary to attach this antenna to the antenna tower by means of an outrigger, or side arm, that extends longitudinally out from the antenna tower. When the antenna tower consists of three vertically-disposed tower legs and truss bracing, it has been customary to construct this side arm from a section of the tower material.

This face-mounted antenna is then mounted at the outer end of the side arm by means of a second electric motor and gear reducer. This type of mounting for a rotatable antenna is highly unsatifactory because of the effect of the metal in the antenna tower. That is, when this face-mounted and rotatable antenna is directed so that the antenna tower is directly behind the antenna, the antenna may be tuned for high performance. However, as the antenna is rotated to an angle where the antenna tower is to one side or the other of the antenna, the tuning of the antenna will be adversely affected. Further, as the antenna is rotated farther, not only will the tuning of the antenna further deteriorate, but also, the direction-sensing ability of the antenna will be adversely affected. That is, if this rotatable antenna is used as a search antenna, false directional readings will be indicated. Then, as the antenna is rotated to face the antenna tower, its tuning will be degraded even more, making the antenna highly ineffective either for transmission or receiving of radio frequencies.

Alternately, face-mounted antennas have been rotated by rotating the entire antenna tower. Of course, this requires an extremely large, heavy, and costly mechanism, is practical only for relatively short antenna towers of the non-guy-wired type, and has the additional disadvantage that all antennas are rotated simultaneously.

Kulikowski, in U.S. Pat. No. 3,623,999, shows an antenna that is mounted to a sleeve which is disposed coaxially around an antenna tower of the tubular mast type, and that is rotated by an electric drive motor. Kulikowski teaches a method of conductance coupling of the antenna to the lead-in conductors; but he does not address the technical problems of providing a workable rotating mount for face-mounting antennas to an antenna tower.

In particular, Kulikowski does not show, disclose, claim, or even intimate the need for, nor solutions for: vertically supporting the antenna, radially guiding the antenna, guiding against sideward tipping of the antenna-mounting ring, counterbalancing of torsional wind loads, use with towers of the trussed tower-leg type rather than the tubular mast type, electrical heating to overcome icing problems, or means for partially assembling the rotating device at ground level and then moving up past the guy wires, all of which are advancements of the present invention.

DISCLOSURE OF INVENTION

In accordance with the broader aspects of this invention, there is provided an antenna tower assembly for the mounting and separately rotating of a plurality of vertically-disposed antennas on a single antenna tower.

In a preferred configuration, a single, two-piece antenna-mounting ring is mounted coaxially around an antenna tower of the type having three vertically-disposed tower legs. This antenna-mounting ring includes a V-shaped groove that is circumferentially disposed in an inner circumferential surface of the antenna-mounting ring.

Three support rollers, having vertically-disposed roller shafts, cooperate with upper and lower surfaces of the V-shaped groove in the antenna-mounting ring to rotatably support the antenna-mounting ring. Two of these support rollers are mounted to respective ones of two of the vertically-disposed tower legs by means of a support-roller assembly. A third one of the support rollers is mounted to the third of the tower legs by means of a support and drive assembly that includes an electric motor and gear reduction unit.

Preferably, the antenna-mounting ring includes a plurality of circumferentially-spaced gear teeth; and the roller shaft of the third support roller includes a drive pinion which meshes with the circumferentially-spaced teeth in the antenna-mounting ring and which is driven by the gear reduction unit.

BEST MODE FOR CARRYING OUT THE INVENTION

Figures 1, 2:
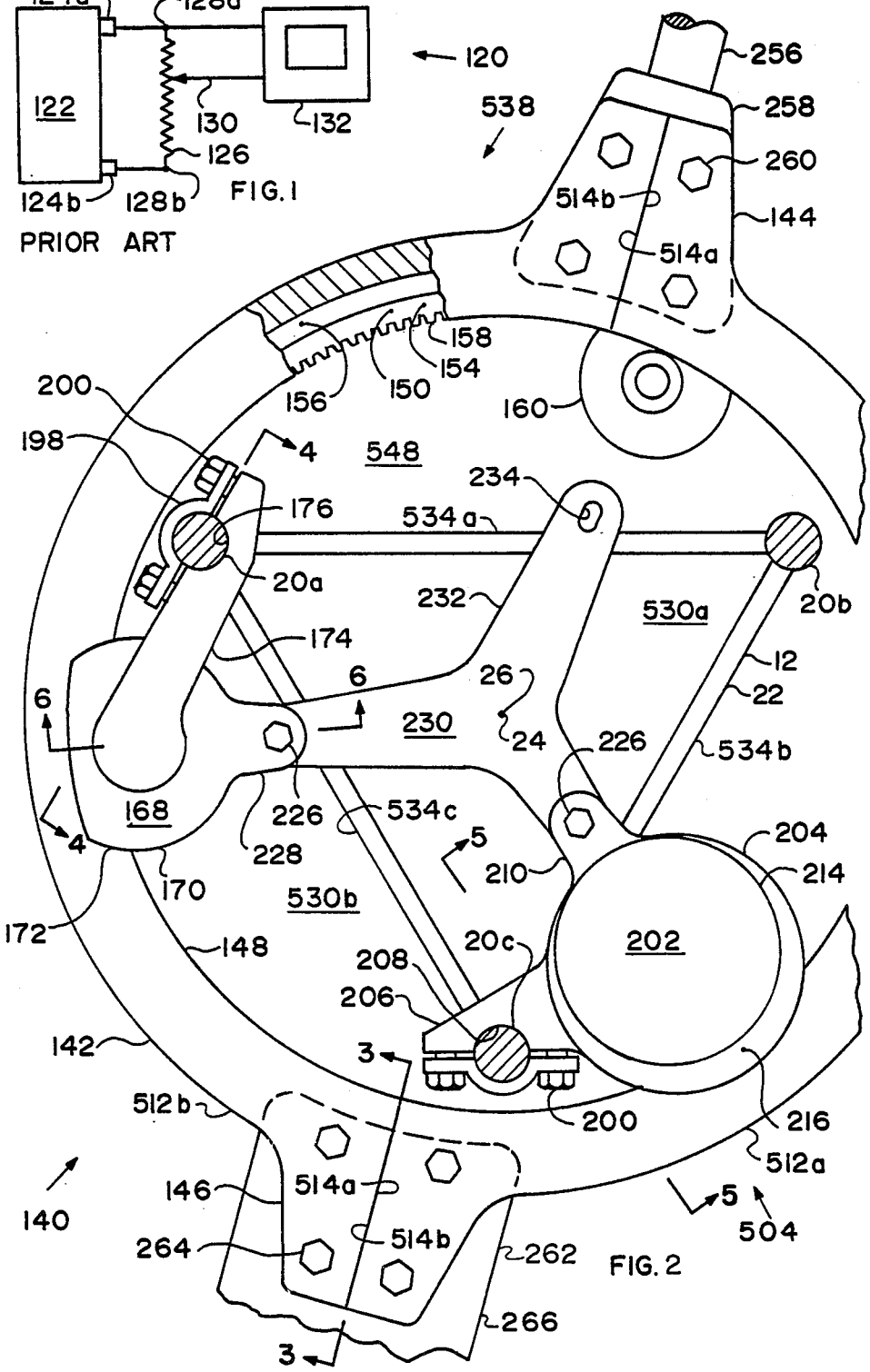
FIG. 1 PRIOR ART
FIG. 1 is a schematic drawing of a direction-indicating device for the embodiments of the succeeding figures.
FIG. 2 is a top plan view of a preferred embodiment in which the roller shafts for the support rollers are vertically disposed.

Referring now to the drawings, and more particularly to FIG. 1, the antenna tower assembly that will be subsequently described includes a position indicator 120. The position indicator 120 includes a regulated power supply 122 having output terminals 124*a* and 124*b*, a potentiometer 126 having legs 128*a* and 128*b* that are connected respectively to the output terminals 124*a* and 124*b* and having an arm 130, and an electrical meter 132 that is connected to the leg 128*a* and to the arm 130 of the potentiometer 126. The potentiometer 126 schematically represents a ten-turn potentiometer, such as is common in the electronics industry.

The use of a ten-turn potentiometer, and an electrical circuit, such as is shown in FIG. 1, to indicate the rotational position of an antenna, is common to the art.

Figure 6:
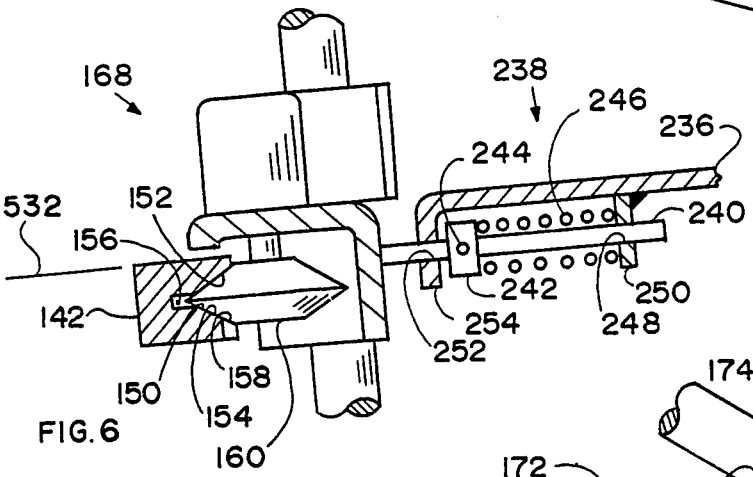
FIG. 6 is a cross-sectional view, taken substantially as shown by section line 6—6 of FIG. 2, showing a modification of the support roller assembly wherein the support roller is resiliently urged into contact with the antenna-mounting ring by a spring.

Referring now to FIGS. 2 and 6, an antenna tower assembly 140 comprises an antenna tower 12 having vertically-disposed tower legs, 20*a*–20*c*, and truss bracing 22. The antenna tower assembly 140 further comprises an antenna-mounting ring 142 having an atenna-attaching lug 144, a counterbalance and wind vane attaching lug 146, a circumferential inner surface or circumferential ring surface 148, a V-shaped circumferential groove 150 that includes an upper groove surface or upper circumferential surface 152 and a lower groove surface or lower circumferential surface 154, a relief groove 156, and a plurality of circumferentially-spaced gear teeth 158.

Figure 4:
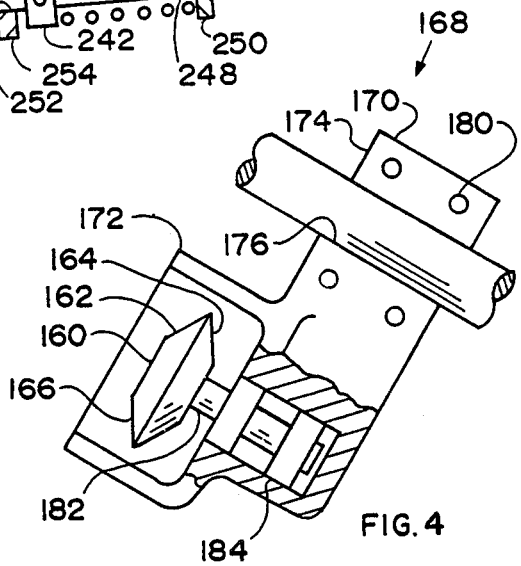
FIG. 4 is a partial side elevation, taken substantially as shown by view line 4—4 of FIG. 2, showing a support roller assembly.

The antenna-mounting ring 142 is supportingly, guidingly, and rotatably attached to the antenna tower 12 by three support rollers such as a support roller 160 of FIGS. 2, 4, and 6.

Referring now to FIG. 4, the support roller 160 includes a wedge-shaped circumferential surface 162 having an upper circumferential support surface 164 that supportingly engages the upper groove surface 152, and having a lower circumferential guide surface 166 that cooperates with the lower groove surface 154 to prevent tilting of the antenna-mounting ring 142.

Referring now to FIGS. 2 and 4, a support roller assembly 168 includes a support housing 170 having a bell-shaped shield 172, a mounting arm 174 having a cylindrical recess 176 therein, and threaded holes 180. The support roller 160 includes a roller shaft 182 which is secured in the housing 170 by longitudinally-spaced ball bearings 184.

Figure 7:
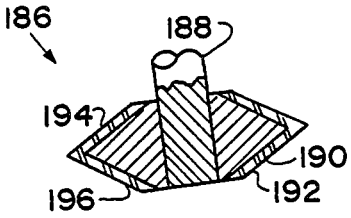
FIG. 7 is an enlarged and partial view of a support roller, taken substantially as shown in FIG. 6, showing a resilient drive surface which may be used in place of the drive pinion of FIG. 5.

Referring now to FIG. 7, in an optional configuration, a support roller 186 includes roller shaft 188. The support roller 186 also includes a roller body 190 which is preferably fabricated from steel, and a resilient cover 192 of molded rubber. Thus, the support roller 186 includes a resilient upper or support surface 194 and a resilient lower or guide surface 196.

Referring again to FIGS. 2 and 4, one of the support roller assemblies 168 is attached to the tower leg 20*a* by a bracket 198 and by bolts 200 that threadably engage the threaded holes 180. A support roller assembly, not shown, which is identical to the support roller assembly 168, is attached to the tower leg 20*b*, the support roller 160 thereof being illustrated.

Figure 5:
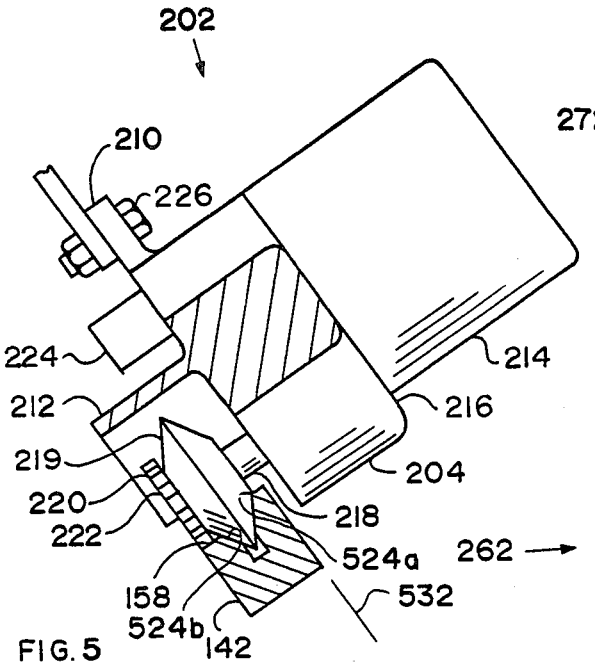
FIG. 5 is a cross-sectional view, taken substantially as shown by section line 5—5 of FIG. 2, showing the support and drive assembly.

Referring now to FIGS. 2 and 5, a support and drive assembly 202 includes a support housing 204 having a mounting arm 206 with a cylindrical recess 208 therein, having an adjusting lug 210, and having a shield portion 212.

The support and drive assembly 202 includes an electric drive motor and gear reducer unit 214 that is attached to a surface 216 of the housing 204 and that is attached to a roller shaft 218. The roller shaft 218 projects through the housing 204.

The support and drive assembly 202 also includes a support roller 219 which is identical to the support roller 160 of FIG. 6 except that the support roller 219 includes the roller shaft 218; and so the support roller 219 includes all of the surfaces as previously described for the support roller 160.

The support and drive assembly 202 also includes a toothed drive pinion 220 that is coaxially attached to the roller shaft 218 and that includes gear teeth 222 which progressively mesh with the gear teeth 158 of the antenna-mounting ring 142.

Finally, the support and drive assembly includes a ten-turn potentiometer 224 that is driven by the electric motor and gear reducer unit 214. The potentiometer 224 and the connection thereof to the electric drive motor and gear reducer unit 214 are conventional and do not comprise an inventive part of the present invention.

Referring now to FIG. 2, the support roller assembly 168 may be rotationally positioned about the tower leg 20*a* by loosening the bolts 200 and a bolt 226 that attaches an adjusting lug 228 of the housing 170 to a spider plate 230. The spider plate 230 includes three legs 232, each of which includes an elongated adjusting hole 234. In like manner, the support and drive assembly 202 may be rotationally positioned about the tower leg 20*c* by loosening the bolts 200 and the bolt 226.

Referring again to FIGS. 2 and 4–6, when any one of the support rollers 160 or 219 is rotationally positioned about the respective one of the tower legs, 20*a*–20*c*, providing close proximity between all the guide surfaces 166 of the support rollers 160 or 219 and the lower groove surface 154 of the antenna-mounting ring 142, the gear teeth 222 of the drive pinion 220 engage the gear teeth 158 of the antenna-mounting ring 142 with proper backlash.

Referring now to FIGS. 2, 6, and 7, preferably the spider plate 230 is modified to provide one leg 236 that includes a spring tension device 238. The spring tension device 238 includes a cylindrical rod 240, a collar 242 which is attached to the rod 240 by a transverse pin 244, and a spring 246. The rod 240 is inserted through a hole 248 in a lug 250 and through a hole 252 in a lug 254, the lug 250 being welded to the leg 236 as shown and the lug 254 being integral with the leg 236. In this modification, the bolts 200 are left slightly loose or shims, not shown, are placed between the bracket 198 and the arm 174 so that the bolts can be tightened without the cylindrical recess 176 being tightened against the tower leg 20*a*.

Therefore, rather than the spider plate 230 being attached to the housing 170 by the lug 228, the rod 240 presses against the housing 170 and resiliently urges the housing 170 to rotate outwardly about the antenna tower leg 20*a*, thereby resiliently urging the support roller 160 thereof into resilient engagement with both the upper groove surface 152 and the lower groove surface 154 of the V-shaped groove 150.

In this adaptation, preferably, the toothed drive pinion 220 and the circumferentially-spaced gear teeth 158 are deleted and the support roller 186, with the resilient surfaces 194 and 196, is used to drive the antenna-mounting ring 142 by friction engagement of the resilient surfaces 194 and 196 with respective ones of the groove surfaces 152 and 154.

Figure 3:
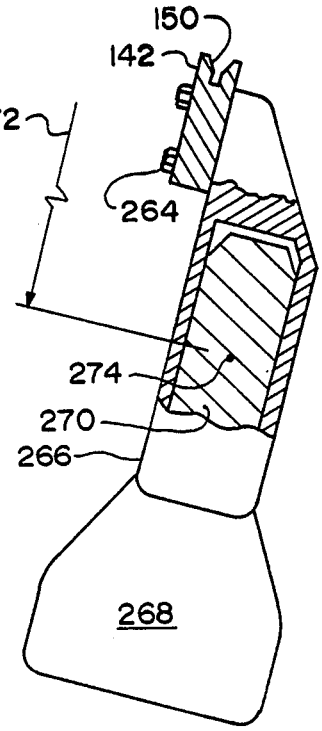
FIG. 3 is a cross-sectional view, taken substantially as shown by section line 3—3 of FIG. 2, showing in reduced scale, the counterweight and wind-vane assembly.

Referring now to FIGS. 2 and 3, an antenna 256 that includes an attaching lug 258 is attached to the lug 144 of the antenna-mounting ring 142 by bolts 260. In like manner, a counterbalance and wind vane assembly 262 is attached to the lug 146 by bolts 264. The counterbalance and wind vane assembly 262 includes a housing 266, a wind vane or wind-resisting member 268, and a counterbalance weight 270 that is retainably inserted into the housing 266.

The wind-resisting member 268 is sized and proportioned to provide a wind-resisting force and torque balance to match and counteract the wind-resisting force and torque applied to the antenna tower 12 by the antenna 256; and the counterbalance weight 270 is sized to effectively counterbalance torque that is applied to the antenna-mounting ring 142 by the antenna 256.

That is, the product of the weight of the counterbalance weight 270 times a distance 272 from a neutral axis 26 of antenna tower 12 to a centroid 274 of the weight 270 is adjusted to substantially equal the weight of the antenna 256 times the distance (not shown) from the neutral axis 26 of the antenna tower 12 to the centroid (not shown) of the weight of the antenna 256.

The embodiment of FIGS. 2–7 includes the mounting of three support rollers to respective ones of three antenna tower legs and both supporting and guiding an antenna-mounting ring by engagement of support and guide surfaces of support rollers with support and guide surfaces of a groove that is circumferentially disposed in the antenna-mounting ring.

In the present invention, a tower-attaching ring, an antenna-mounting ring, or any other ring or arcuate segment, may be built or assembled as a tower-retaining ring. Thus, whether the tower-retaining ring is a tower-attaching ring or an antenna-mounting ring, it is assembled to the tower 12, at any convenient height position, by moving a first arcuate segment transversely toward the tower 12 and into an arcuate relationship with the tower 12, by moving a second arcuate segment transversely toward the tower 12 and into tower-encircling relationship with the first arcuate segment, and by interconnecting ends of the arcuate segments.

Referring now to FIGS. 2–7, the method of rotatably mounting an antenna 256 to an antenna tower 12 having three vertically-disposed tower legs, 20*a*–20*c*, comprises attaching one of the support housings 170 to each of two of the tower legs, 20*a* and 20*b*, attaching the support housing 204 to the tower leg 20*c*, placing the antenna-mounting ring 142 around the tower 12, rotatably connecting the ring 142 to the support housing 170 and to the support housing 204 by attaching the support rollers 160 and 219 to the housings 170 and 204, and attaching an antenna 256 to the ring 142.

Referring now to FIG. 2, if the antenna 256 of the antenna tower 12 is deleted from the antenna tower assembly 140, the antenna tower assembly becomes rotationally positionable mount 504.

The antenna-mounting ring 142 includes first and second arcuate segments 512*a* and 512*b*, each having first and second ends 514*a* and 514*b*. The arcuate segments 512*a* and 512*b* are positioned around the antenna tower 12 with the first ends 514*a* abutting the second ends 514*b*. The arcuate segments 512*a* and 512*b* may be interconnected by the attaching lug 258 and the bolts 260, and by the bolts 264 attaching the housing 266 to both of the arcuate segments 512*a* and 512*b*. However, the method and details of connection of the ends 514*a* and 514*b* of the segments 512*a* and 512*b* are not a part of the present invention.

Referring again to FIG. 2, the arcuate segments 512*a* and 512*b* each include arcuate surfaces 524*a* and 524*b*. The upper circumferential surface 152, includes one arcuate surface, 524*a*, on each of the respective ones of the arcuate segments, 512*a* and 512*b*; and the lower circumferential surface 154 includes one arcuate surface 524*b* on each of the arcuate segments 512*a* and 512*b*.

The arcuate segments 512*a* and 512*b* each include an opening, 530*a* or 530*b*, that is disposed radially inward of an arcuate surface 152 or 154, and that opens outward between the ends 514*a* and 514*b* of respective ones of the arcuate segments.

Preferably, all of the segments and rings are disposed about a vertical axis or segment axis 26 that is parallel to the neutral axis 24 of the antenna tower; so all of the segments and rings are disposed in a plane 532 that is orthogonal to the neutral axis 24; and so the circumferential surfaces 152 and 154 are disposed circumferentially around the axis 26. The ring 142 includes a tower-receiving or tower-accepting opening 548 that includes the openings 530*a* and 530*b* of the respective arcuate segments.

Referring again to FIG. 2, the antenna tower 12 includes three faces 534*a*–534*c* which comprise a side of the tower 12 that is disposed between any adjacent two of the tower legs 20*a*–20*c*. Thus, in broadest terms, the rotationally positionable mount 504 is attached to a face 534*a*–534*c* of the tower 12, as opposed to being attached to a top (not shown) of the tower 12.

In the embodiment of FIGS. 2–7, the first mounting portion includes two of the support housings 170 and the support housing 204; and the antenna-mounting ring 292 is the second mounting portion.

In the embodiment of FIGS. 2–7, the first and second mounting portions are interconnected by attaching a support roller 166 to each of the support housings 170 and by attaching a support roller 219 to the support housing 204.

Referring finally to FIGS. 2–7, if the antenna 256 and the wind vane 268 are deleted from the tower and rotationally positionable mount assembly 140, then the assembly becomes tower and rotationally positionable mount assembly 538.

In summary, the present invention provides means for rotatably mounting one or more search devices to the face of a tower. The search devices which may be mounted include ratio antennas, video cameras, and searchlights.

The present invention provides an embodiment wherein a search-device mounting ring is rotatably attached to the three tower legs of the tower by a roller that is operatively attached to each tower leg and that engages a groove in the search-device mounting ring. In this embodiment, the roller shafts are vertically disposed and are both radially and circumferentially disposed about a vertical axis.

This vertical axis is preferably the neutral axis of the tower, but it may be any vertical axis that is disposed radially inside the tower legs and truss bracing of the tower.

The present invention includes: roller and groove means for supporting, guiding, and stabilizing the search-device mounting ring, counterbalance means for counter-balancing the weight of a search device, torsional wind balance means for counteracting torsional wind loads that are applied to the tower by the search device, electrical means for rotating the search device, and apparatus and method for assembling the tower-attaching and antenna-mounting rings about the antenna tower at any convenient height.

The support rollers cooperate with a first circumferential surface to support a ring-shaped mounting portion, cooperate with a second circumferential surface to vertically restrain the ring-shaped mounting portion and thereby to prevent tilting of the ring-shaped mounting portion, and cooperate with one of the mounting portions to radially guide the ring-shaped mounting portion, as shown in FIGS. 2, 5, and 6.

The support rollers each include a roller shaft; and respective ones of the support rollers are supported, vertically restrained, and radially restrained by operative attachment of the respective ones of the roller shafts to another mounting portion, as shown in the drawings.

The present invention provides apparatus and method for mounting a plurality of antennas, or search devices, to a single tower, and for separately rotating, or rotationally positioning, the antennas or search devices.

Therefore, the present invention provides functional advantages over prior art systems wherein only one antenna can be rotated, and economic advantages over prior art systems wherein multiple towers are required.

Further, the present invention allows the use of larger antennas on a given size of tower, the use of a larger number of antennas on a given size of tower, or the use of a tower of smaller cross-sectional dimensions and less torsional rigidity for a given number of antennas of a given size; because all of the embodiments of the present invention apply torsional loads equally to all of the tower legs, and because of the torsional wind balance that is provided by the use of wind vanes.

Industrial Applicability

The present invention provides apparatus and methods for the rotatable mounting and both separate and selective rotational positioning of a plurality of antennas or search devices on a single tower.

The present invention may be used by homeowners for mounting and rotating of antennas of the types used for receiving video signals, for broadcasting and receiving of citizens band radio signals, and for receiving both AM and FM radio signals.

The present invention may be used by radio amateurs for both broadcasting and receiving antennas, by commercial radio stations, by microwave transmission companies, and by the military forces for radio communications.

In addition, the present invention may be used to mount and separately rotate such search devices as directional receiving antennas, video cameras, and searchlights in such numbers or combinations as are needed.

What is claimed is:

1. A tower and rotationally positionable mount assembly (538) which comprises a tower (12) having three vertically-disposed tower legs **(20*a*–20*c*), having bracing (22) intermediate of adjacent pairs of said tower legs that defines a plurality of faces (534*a*–534*c*) of said tower, and having a neutral axis (26)** that is disposed intermediate of said faces;

first mounting portion means (170+204) for operative attachment to one of said faces of said tower;

second mounting portion means (142), having a tower-receiving opening (548), and being disposed circumferentially around all of said tower legs, for mounting a device (256 or 266) thereto;

attaching means for supportingly attaching said second mounting portion means to said first mounting portion means, for permitting said second mounting portion means to be rotationally positioned with respect to said first mounting portion means, for vertically restraining said second mounting portion means, and for radially guiding said second mounting portion means; and rotational positioning means, comprising a drive motor (214) that is operatively attached to one (170+204) of said mounting portion means, and comprising a friction drive element (186 or 219) that is operatively connected to said drive motor, for providing a friction drive connection between said drive motor and said other (142) mounting portion means, and for rotationally positioning said second mounting portion means.

2. A tower and rotationally positionable mount assembly (538) as claimed in claim 1 in which said attaching means comprises a plurality of roller shafts (182, 188, or 218) being operatively attached to said one (170+204) mounting portion means, a plurality of rollers (160, 186, or 219) being operatively attached to said roller shafts, and operative engagement of said rollers with said other (142) mounting portion means.

3. A tower and rotationally positionable mount assembly (538) as claimed in claim 1 in which said rotational positioning means includes a shaft (188 or 218) that is operatively connected to said drive motor (214);

said rotational positioning means further includes a roller (186 or 219) that is operatively attached to said shaft;

said friction drive element comprises said roller; and said operative connection of said friction drive element to said drive motor comprises said operative connection of said shaft to said drive motor and said operative attachment of said roller to said shaft.

4. A tower and rotationally positionable mount assembly (538) as claimed in claim 1 in which said attaching means comprises a plurality of roller shafts (182, 188, or 218) being operatively attached to said one (170+204) mounting portion means, a plurality of rollers (160, 186, or 219) being operatively attached to said roller shafts, and operative engagement of said rollers with said other (142) mounting portion means;

said friction drive element comprises one (186 or 219) of said rollers; and said operative connection of said friction drive element to said drive motor (214) comprises operative connection of said drive motor to one (188 or 218) of said roller shafts, and said operative attachment of one of said rollers to said one roller shaft.

5. A tower and rotationally positionable mount assembly (538) as claimed in claim 1 in which said other (142) mounting portion means comprises first (152) and second (154) circumferential surfaces;

said assembly includes a plurality of roller shafts that are disposed radially outward from a second axis (24) that is disposed substantially parallel to said neutral axis (26), that are disposed circumferentially around said second axis, and that are operatively attached to said one (170+204) mounting portion means;

said assembly further includes a plurality of rollers (160, 186, or 219) that are operatively attached to said shafts, and that provide roller surface means for cooperating with said first and second circumferential surfaces;

said attaching means, comprises said first and second circumferential surfaces and also comprises said roller surface means, said supportive attaching of said second mounting portion means (142) to said first mounting portion means comprises operative engagement of said roller surface means with said first (152) circumferential surface, and said vertical restraining of said second mounting portion means comprises close proximity of said second circumferential surface to said roller surface means;

said friction drive element comprises one (186 or 219) of said rollers; and said operative connection of said friction drive element to said drive motor (214) comprises operative connection of said drive motor to one (188 or 218) of said roller shafts, and said operative attachment of said one roller to said one roller shaft.

6. A tower and rotationally positionable mount assembly (538) as claimed in claim 5 in which said other (142) mounting portion means includes a ring surface (148) and a circumferential groove (150) that extends radially into said other mounting portion means from said ring surface and that includes first (152) and second (154) groove surfaces; and said first and second circumferential surfaces comprise said first and second groove surfaces.

7. A tower and rotationally positionable mount assembly (538) as claimed in claim 6 in which one of said groove surfaces (152 or 154) diverge from the other (154 or 152) of said groove surfaces as said groove surfaces approach said ring surface (148);

said roller surface means (162 or 192) comprises a profiled surface (164, 166, 194, or 196); and said radial guiding comprises said one diverging groove surface and said profiled surface.

8. A tower and rotationally positionable mount assembly (538) as claimed in claim 5 in which said roller surface means comprises first (164 or 194) roller surfaces and second (166 or 196) roller surfaces;

said operative engagement of said roller surface means with said first (152) circumferential surface comprises operative engagement of said first roller surfaces (164 or 194) with said first circumferential surface; and said close proximity of said second circumferential surface (154) to said roller surface means comprises close proximity of said second circumferential surface to said second roller surfaces (166 or 196).

9. A tower and rotationally positionable mount assembly (538) as claimed in claim 8 in which said close proximity of said second circumferential surface (154) to said second roller surfaces (166 or 196) comprises contact of said second circumferential surface with said second roller surfaces (166 or 196).

10. A tower and rotationally positionable mount assembly (538) as claimed in claim 1 in which said second mounting portion (142) includes a first (512*a*) segment having first (514*a*) and second (514*b*) ends, and having a first opening (530*a*) that is disposed intermediate of said first and second ends and that opens outwardly between said first and second ends;

said secong mounting portion further includes a second (512*b*) segment having third (514*a*) and fourth (514*b*) ends, and a second (530*b*) opening that is disposed intermediate of said third and fourth ends and that opens outwardly between said third and fourth ends; and said tower-receiving opening (548) comprises said first and second openings.

11. A rotationally positionable mount (504) for mounting a device (256 or 266) to a tower (12) of the type having three vertically-disposed tower legs (20*a*–20*c*), having bracing intermediate of adjacent pairs of said tower legs that defines a plurality of faces (534*a*–534*c*), and having a neutral axis (26) intermediate of said faces, which mount comprises first mounting portion means (170+204) for operative attachment to one of said faces of said tower;

second mounting portion means (142), having a tower-receiving opening (548), for receiving all of said tower legs in said tower-receiving opening, for circumscribing all of said tower legs, and for mounting said device thereto;

attaching means for supportingly attaching said second mounting portion means to said first mounting portion means, for permitting said second mounting portion means to be rotationally positioned with respect to said first mounting portion means, for vertically restraining said second mounting portion means, and for radially guiding said second mounting portion means; and rotational positioning means, comprising a drive motor (214) that is operatively attached to one (170+204) of said mounting portion means, and comprising a friction drive element (186 or 219) that is operatively connected to said drive motor, for providing a friction drive connection between said drive motor and said other (142) mounting portion means, and for rotationally positioning said second mounting portion means.

12. A rotationally positionable mount (504) as claimed in claim 11 in which said attaching means comprises a plurality of roller shafts (182, 188, or 218) being operatively attached to said one (170+204) mounting portion means, a plurality of rollers (160, 186, or 219) being operatively attached to said roller shafts, and operative engagement of said rollers with said other (142) mounting portion means.

13. A rotationally positionable mount (504) as claimed in claim 11 in which said rotational positioning means includes a shaft (188 or 218) that is operatively connected to said drive motor (214);

said rotational positioning means further includes a roller (186 or 219) that is operatively attached to said shaft;

said friction drive element comprises said roller; and said operative connection of said friction drive element to said drive motor comprises said operative connection of said shaft to said drive motor and said operative attachment of said roller to said shaft.

14. A rotationally positionable mount (504) as claimed in claim 11 in which said attaching means comprises a plurality of roller shafts (182, 188, or 218) being operatively attached to said one (170+204) mounting portion means, a plurality of rollers (160, 186, or 219) being operatively attached to said roller shafts, and operative engagement of said rollers with said other (142) mounting portion means;

said friction drive element comprises one (186 or 219) of said rollers; and said operative connection of said friction drive element to said drive motor (214) comprises operative connection of said drive motor to one (188 or 218) of said roller shafts, and said operative attachment of one of said rollers to said one roller shaft.

15. A rotationally positionable mount (504) as claimed in claim 11 in which said other (142) mounting portion means comprises first (152) and second (154) circumferential surfaces;

said mount includes a plurality of roller shafts that are disposed radially outward from a second axis (24) that is disposed substantially parallel to said neutral axis (26), that are disposed circumferentially around said second axis, and that are operatively attached to said one (170+204) mounting portion means;

said mount further includes a plurality of rollers (160, 186, or 219) that are operatively attached to said shafts, and that each include roller surface means for cooperating with said first and second circumferential surfaces;

said attaching means, comprises said first and second circumferential surfaces and said roller surface means, said supportive attaching of said second mounting portion means (142) to said first mounting portion means comprises operative engagement of said roller surface means with said first (152) circumferential surface, and said vertical restraining of said second mounting portion means comprises close proximity of said second circumferential surface to said roller surface means;

said friction drive element comprises one (186 or 219) of said rollers; and said operative connection of said friction drive element to said drive motor (214) comprises operative connection of said drive motor to one (188 or 218) of said roller shafts, and said operative attachment of said one roller to said one roller shaft.

16. A rotationally positionable mount (504) as claimed in claim 11 in which said second mounting portion (142) includes a first (512*a*) segment having first (514*a*) and second (514*b*) ends, and having a first opening (530*a*) that is disposed intermediate of said first and second ends and that opens outwardly between said first and second ends;

said second mounting portion further includes a second (512*b*) segment having third (514*a*) and fourth (514*b*) ends, and a second (530*b*) opening that is disposed intermediate of said third and fourth ends and that opens outwardly between said third and fourth ends; and said tower-receiving opening (548) comprises said first and second openings.

17. A method for rotatably mounting a device (256 or 266) to a vertically-disposed tower (12) of the type having three vertically-disposed tower legs (20*a*–20*c*), and for rotationally positioning said device, which method comprises:

(a) attaching a first mounting portion (170+204) to said tower;

(b) providing a ring-shaped second mounting portion (142) that includes a tower receiving opening (548);

(c) placing said second mounting portion circumferentially around said tower;

(d) supportingly and rotatably attaching said second mounting portion to said first mounting portion;

(e) operatively attaching a drive motor (214) to one (204) of said mounting portions;

(f) operatively connecting a friction drive element (186 or 219) to said drive motor (214); and (g) providing a friction drive connection between said friction drive element and the other (142) of said mounting portions.

18. A method as claimed in claim 17 in which said supportingly and rotatably attaching step comprises:

(a) operatively attaching a plurality of roller shafts (182, 188, or 218) to said one (170+204) mounting portion;

(b) operatively attaching a plurality of rollers (160, 186, or 219) to said roller shafts; and (c) supportingly and rotatably engaging said rollers with said other (142) mounting portion.

19. A method as claimed in claim 17 in which said supportingly and rotatably attaching step comprises operatively attaching a plurality of roller shafts (182, 188, or 218) to said one (170+204) mounting portion, operatively attaching a plurality of rollers (160, 186, or 219) to said roller shafts, and engaging said rollers with said other (142) mounting portion; and said friction drive element comprises one (186 or 219) of said rollers.

20. A method as claimed in claim 17 in which said placing step comprises:

(a) moving a first segment (512*a*) transversely toward said tower (12) and into an arcuate relationship to said tower;

(b) moving a second segment (512*b*) transversely toward said tower, into an arcuate relationship to said tower, and into a tower-encircling relationship with said tower; and (c) connecting said first and second segments into said ring-shaped second mounting portion (142).

* * * * *